US011259673B2

(12) United States Patent
Lee et al.

(10) Patent No.: US 11,259,673 B2
(45) Date of Patent: Mar. 1, 2022

(54) DIRT SUCTION GUIDE DEVICE AND CLEANER COMPRISING SAME

(71) Applicant: Samsung Electronics Co., Ltd, Gyeonggi-do (KR)

(72) Inventors: Hyun-ju Lee, Suwon-si (KR); Soo-hyun Yoon, Hanam-si (KR); Han-saem Lee, Seongnam-si (KR); Byeong-soo Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 426 days.

(21) Appl. No.: 15/757,938

(22) PCT Filed: Jul. 4, 2016

(86) PCT No.: PCT/KR2016/007165
§ 371 (c)(1),
(2) Date: Mar. 6, 2018

(87) PCT Pub. No.: WO2017/043743
PCT Pub. Date: Mar. 16, 2017

(65) Prior Publication Data

US 2019/0357742 A1 Nov. 28, 2019

(30) Foreign Application Priority Data

Sep. 7, 2015 (KR) ..... 10-2015-0126518

(51) Int. Cl.
*A47L 5/28* (2006.01)
*A47L 9/02* (2006.01)
(Continued)

(52) U.S. Cl.
CPC ..... *A47L 5/28* (2013.01); *A47L 9/02* (2013.01); *A47L 5/00* (2013.01); *A47L 5/225* (2013.01);
(Continued)

(58) Field of Classification Search
CPC ..... A47L 9/24; A47L 9/06; A47L 5/00; A47L 9/00; A47L 9/0072; A47L 9/0081; A47L 9/242; A47L 5/28; A47L 9/02
(Continued)

(56) References Cited

U.S. PATENT DOCUMENTS 4,961,245 A 10/1990 Barnes, Jr. et al.
6,032,328 A * 3/2000 Harmon ..... A47L 9/02 15/416
(Continued)

FOREIGN PATENT DOCUMENTS

JP H05-003844 A 1/1993
JP 2009-066333 A 4/2009
(Continued)

OTHER PUBLICATIONS

Supplementary European Search Report dated Sep. 12, 2018, in connection with European Patent Application No. 16 84 4563, 9 pages.
(Continued)

*Primary Examiner* — Katina N. Henson

(57) ABSTRACT

Disclosed are a dirt suction guide device and a cleaner comprising the same. The disclosed cleaner comprises: a cleaner body for generating a suction force; a flexible hose connected to the cleaner body; an extension tube connected to the flexible hose; and a dirt suction guide device separately coupled to the extension tube, wherein the dirt suction guide device comprises a body, a movable portion, which is connected to one side of the body, and which is coupled to be able to slide with regard to the body, and a connecting portion, which is connected to the other side of the body, and which connects the body to the extension tube, and the body is hinge-coupled such that the same can selectively maintain and change an angle with regard to the extension tube.

11 Claims, 23 Drawing Sheets

(51) Int. Cl.

| | |
|---|---|
| *A47L 5/22* | (2006.01) |
| *A47L 9/16* | (2006.01) |
| *A47L 9/24* | (2006.01) |
| *A47L 9/32* | (2006.01) |
| *A47L 5/00* | (2006.01) |
| *A47L 9/00* | (2006.01) |
| *A47L 9/06* | (2006.01) |

(52) U.S. Cl.
CPC ..... *A47L 9/00* (2013.01); *A47L 9/0072* (2013.01); *A47L 9/06* (2013.01); *A47L 9/1683* (2013.01); *A47L 9/24* (2013.01); *A47L 9/244* (2013.01); *A47L 9/322* (2013.01)

(58) Field of Classification Search
USPC ..... 15/415.1
See application file for complete search history.

(56) References Cited

U.S. PATENT DOCUMENTS

| | | | |
|---|---|---|---|
| 8,533,907 | B2 | 9/2013 | Eccardt et al. |
| 2006/0156510 | A1 | 7/2006 | Park et al. |
| 2007/0209144 | A1 | 9/2007 | Fester et al. |

FOREIGN PATENT DOCUMENTS

| | | | |
|---|---|---|---|
| JP | 2009261432 | A | 11/2009 |
| JP | 2009297370 | A | 12/2009 |
| JP | 2011-224224 | A | 11/2011 |
| JP | 5452065 | B2 | 3/2014 |
| JP | 2015042320 | A | 3/2015 |
| KR | 20-1994-000349 | U | 1/1994 |
| KR | 1999-0032996 | U | 7/1999 |
| KR | 20-0233129 | Y1 | 10/2001 |
| KR | 10-2009-0122653 | A | 12/2009 |

OTHER PUBLICATIONS

International Search Report dated Oct. 19, 2016 in connection with International Patent Application No. PCT/KR2016/007165.

Written Opinion of the International Searching Authority dated Oct. 19, 2016 in connection with International Patent Application No. PCT/KR2016/007165.

Notice of Preliminary Rejection dated Jul. 7, 2021 in connection with Korean Patent Application No. 10-2015-0126518, 11 pages.

* cited by examiner

DIRT SUCTION GUIDE DEVICE AND CLEANER COMPRISING SAME

CROSS-REFERENCE TO RELATED APPLICATIONS

The present application is a National Stage of International Application No. PCT/KR2016/007165 filed Jul. 4, 2016, which claims the benefit of Korean Patent Application No. 10-2015-0126518 filed Sep. 7, 2015, the disclosures of which are fully incorporated herein by reference into the present disclosure as if fully set forth herein.

TECHNICAL FIELD

The present invention relates to a dirt suction guide device and a cleaner including the same, and more particularly, to a dirt suction guide device having a suction member coupled to be drawn into and drawn out from a suction nozzle body and a cleaner including the same.

BACKGROUND

In general, cleaners may be home appliances which include a cleaner main body configured to generate suction force, a handle part of which an extension tube is coupled to one end, a flexible hose configured to couple the other end of the handle part and the main body, and a suction device separately coupled to the extension tube and perform cleaning.

The conventional cleaners include various accessories, which are usable to replace a suction nozzle, so as to clean various surfaces to be cleaned according to types and states of the surfaces to be cleaned. In particular, the accessories may include a crevice flatly formed to clean a narrow gap such as a window frame. Such a crevice may be used to perform cleaning on the narrow gap as well as fabrics such as a curtain installed in a room, clothes hanging on hangers, and the like.

However, since the suction port of the crevice is narrowly formed and has a small suction region, it is cumbersome to replace the crevice with a suction nozzle, for example, in response to a floor around furniture being directly cleaned while cleaning a gap between a wall and the furniture.

Since conventional crevices have only one function to clean a gap, the conventional devices has low availability.

The present invention has been made in view of the above problems, and the object of the present invention is to provide a dirt suction guide device capable of being deformed in various forms according to a cleaning environment and improving usage convenience by increasing a cleaning region only through a simple movement of the user.

SUMMARY

To obtain the above-described object, the present invention is to provide a cleaner including a cleaner main body configured to generate suction force; a flexible hose connected to the cleaner main body; an extension tube connected to the flexible hose; and a dirt suction guide device separately coupled to the extension tube. The dirt suction guide device includes a tubular body; a movable part connected to a front portion of the main body and slidably coupled to the body; and a coupling part connected to a rear portion of the body and configured to couple the body to the extension tube. The body may be hinge-coupled to the coupling part so that the body maintains and changes an angle with respect to the extension tube.

The body may include a close/open suction port and the close/open suction port may be closed in response to the movable part being set to an extension position that the movable part is drawn out from the body and may be opened in response to the movable part being set to a contraction position that the movable part is drawn into an inner side of the body.

The movable part may include a first suction member; and a second suction member formed to extend in a rear side of the first suction member and having a tubular shape.

The second suction member may close the open/close suction port in the extension position and open the open/close suction port in the contraction position.

The movable part may further include a detent part so that the movable part is set to the contract position and the detent part may include at least one detent protrusion formed in the first suction member; and at least one detent protrusion groove formed in the body so that the at least one detent protrusion passes through the at least one detent protrusion groove and is received in the at least one detent protrusion groove.

The first suction member may be formed of a flexible material to be bent. The second suction member may be formed of a rigid material.

A pressure adjusting hole configured to adjust pressure of a first opening in the extension position may be formed in the first suction member.

The cleaner may further include a first flow path which extends from a first opening of the first suction member to a second opening of the first suction member via an inner side of the first suction member; a second flow path which extends from the open/close suction port of the body to a first opening of the second suction member, the inner side of the first suction member, and a second opening of the second suction member; and a third flow path formed in an inside of the body and connected to the first and second flow paths. The second flow path may be blocked in the extension position and may communicate with the outside in the contraction position.

A length of the third flow path may be increased in the extension position and may be reduced in the contraction position.

The coupling part may include a first coupling part; a second coupling part which is coupled to the body and is rotatably received in the first coupling part; and a deviation preventing part configured to prevent the first coupling part and the second coupling part from being mutually separated.

The deviation preventing part may include a first deviation preventing part disposed in an upper side of the first coupling part; and a second deviation preventing part separately coupled to the first deviation preventing part and disposed in a lower side of the first coupling part.

The cleaner may further include an angle adjusting part configured to allow the body to rotate by a preset angle. The angle adjusting part may include a plurality of locking grooves formed at constant intervals in the deviation preventing part; a plurality of guide grooves formed at constant intervals in the second coupling part; and a fixing part including a plurality of locking protrusions guided in a state received in the guide grooves and selectively received in portions of the plurality of locking grooves.

The angle adjusting part may further include an elastic member configured to press the fixing part toward a locking groove side.

The coupling part may include a shaft part; and a holder part coupled to the body and configured to rotatably support the shaft part.

The cleaner may further include an angle adjusting part configured to allow the body to rotate by a preset angle. The angle adjusting part may include a plurality of receiving grooves formed at constant intervals in the holder part; and a plate spring which is disposed in the shaft part and a portion thereof is sequentially elastically received in the plurality of receiving grooves along a rotation direction of the body.

The angle adjusting part may include a first protrusion portion formed in the shaft part; and a second protrusion portion coupled to the holder part and formed to be elastically locked and unlocked to the first protrusion portion.

The body may be selectively maintained so that the body is selectively maintained at an angle with respect to the extension tube.

The present invention is to provide a dirt suction guide device including a tubular body; a movable part connected to a front portion of the body and slidably coupled to the body; and a coupling part connected to a rear portion of the body and configured to couple the body to an extension tube. The body may be hinge-coupled to the coupling part so that the body maintains and changes an angle with respect to the extension tube.

A close/open suction port included in the body may be closed in response to the movable part being set to an extension position that the movable part is drawn out from the body and may be opened in response to the movable part being set to a contraction position that the movable part is drawn into an inner side of the body. The movable part may include a first suction member formed of a flexible material; and a second suction member configured to close the open/close suction port in the extension position and open the open/close suction port in the contraction position.

The cleaner capable of filtering dirt of the sucked air in the cleaner main body and discharging the purified air to the outside of the cleaner main body may be provided.

The dirt suction guide device capable of reducing cost through configuration simplification and improving an aesthetic sense of an outer appearance may be provided.

DETAILED DESCRIPTION

Figure 1:
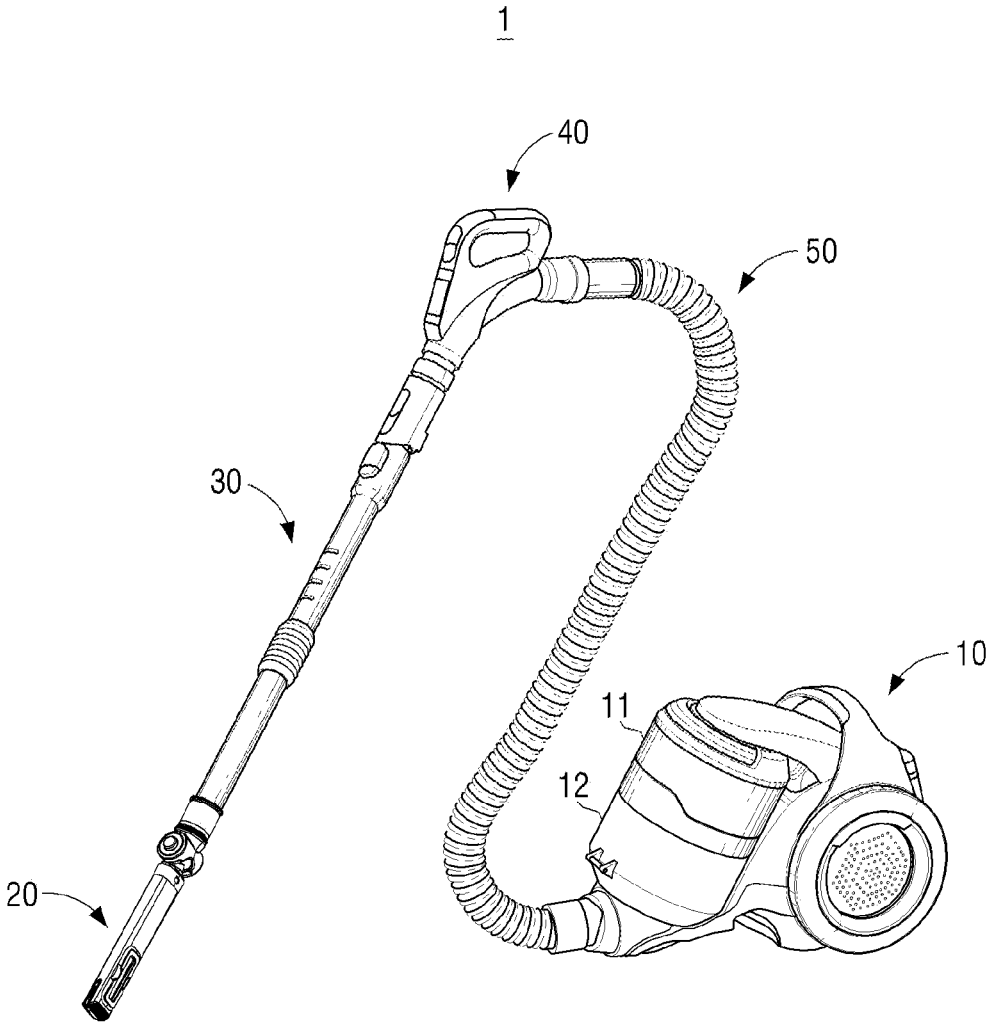
FIG. 1 is a diagram illustrating an entire configuration of a cleaner including a dirt suction guide device according to a first embodiment of the present invention.

Hereinafter, exemplary embodiments of the invention will be described more fully with reference to the accompanying drawings, in which the exemplary embodiments of the invention are shown to understand a configuration and an effect of the invention. The embodiments described herein are exemplary for the understandings of the present invention, and should not be construed as implying any particular limitation on the present disclosure. This invention may, however, be embodied and modified in many different forms and should not be construed as limited to the exemplary embodiments set forth herein. To more clearly describe features of the exemplary embodiments, detailed description for contents widely known to those skilled in the art will be omitted for clarity. In the drawings, sizes of elements may be enlarged and a ratio between the elements may be exaggerated or reduced for clarity.

A dirt suction guide device 20 according to a first embodiment of the present invention will be described with reference to FIG. 1. FIG. 1 illustrates a diagram illustrating an entire configuration of a cleaner 1 including the dirt suction guide device 20 according to the first embodiment of the present invention.

Referring to FIG. 1, the cleaner 1 includes a cleaner main body 10, a dirt suction guide device 20, an extension tube 30, a handle part 40, and a flexible hose 50.

The cleaner main body 10 is provided with a fan motor device (not shown) configured to suction force, a dust collection device 11 configured to filter dirt and dust from the sucked air, and a dirt collection part 12 configured to collect the filtered dirt and dust.

The dirt suction guide device 20 may be separately coupled to the extension tube 30. The dirt suction guide device 20 may suck dirt of a surface to be cleaned with the air toward the extension tube 30 side through the suction force generated in the cleaner main body 10. The dirt suction guide device 20 may have a thin and long shape to be located in a narrow space, for example, a gap space such as a window frame and to perform cleaning on the narrow space. Further, an open/close suction port 140 to be described later may be formed in a side surface of the dirt suction guide device 20 to easily clean a hard floor such as a wooden floor, fabrics such as carpet as well as a curtain installed in a room, clothes hanging on clothes hangers, and the like. The air and dirt sucked through the dirt suction guide device 20 may be guided to the extension tube 30. Detailed description for the dirt suction guide device 20 will be described later.

The extension tube 30 may be configured of a pipe formed of a resin or a metal material. The extension tube 30 may be disposed between the dirt suction guide device 20 and the handle part 40 and may separately couple the dirt suction guide device 20 and the handle part 40.

The extension tube 30 may be separately coupled to one end of the handle part 40 and the flexible hose 50 may be connected to the other end of the handle part 40. The handle part 40 may communicate with the main body through the flexible hose 50. The user may grip the handle part 40 and may easily operate the directions of the dirt suction guide device 20 and the extension tube 30. Various operation buttons (not shown) configured to select functions of the cleaner may be provided in the handle part 40.

The flexible hose 50 may be disposed between the handle part 40 and the cleaner main body 10. The flexible hose 50 may be formed of a flexible resin material so that the user freely operates the handle part 40.

Through the configuration, the air and dirt of the surface to be cleaned are sucked into the dirt suction guide device 20 through the suction force generated in the cleaner main body 10 and the sucked air and dirt are guided to the cleaner main body 10 sequentially via the extension tube 30, the handle part 40, and the flexible hose 50. The dirt of the sucked air may be filtered in the cleaner main body 10 and the purified air may be discharged to the outside of the cleaner main body 10.

Figure 2:
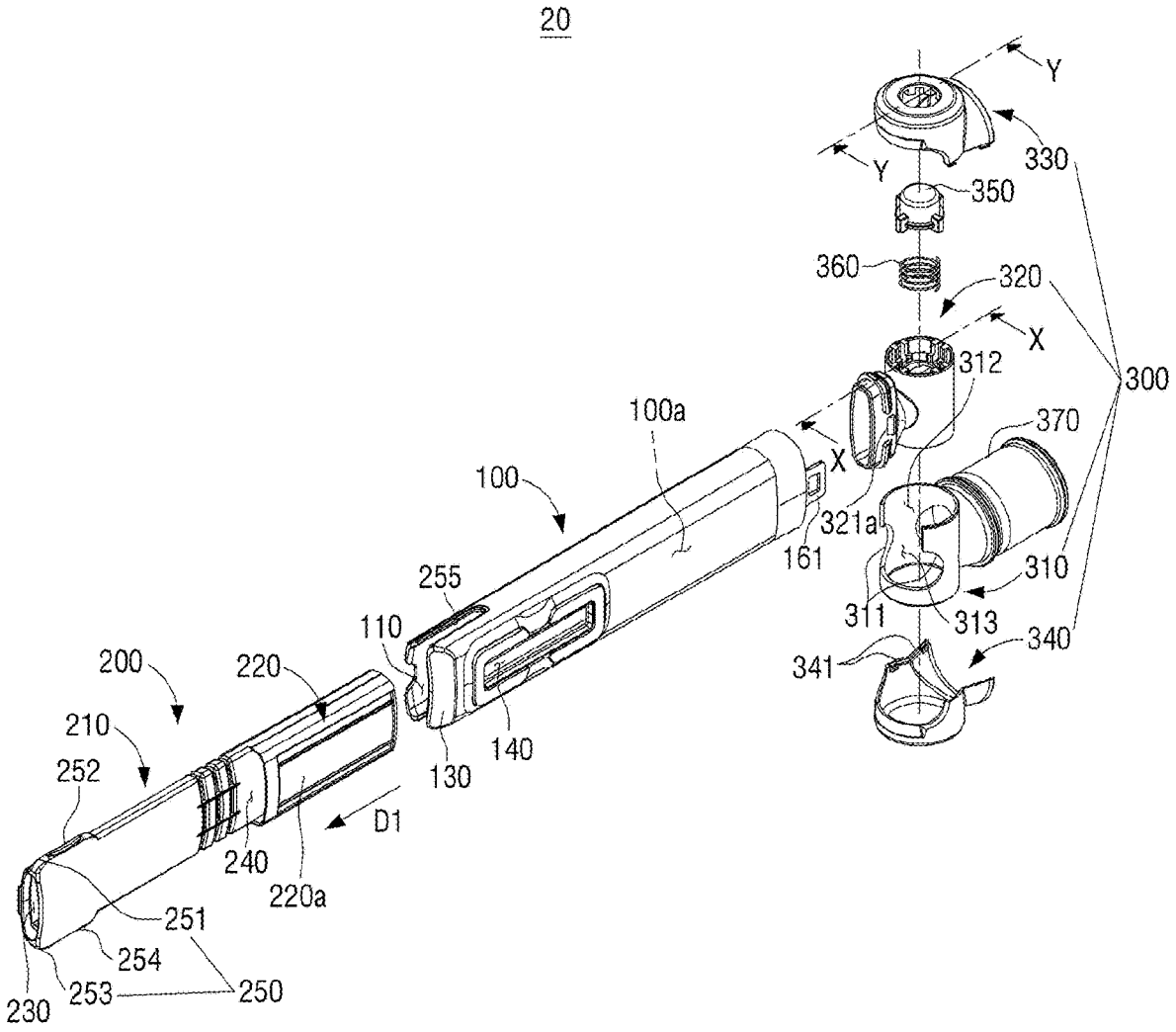
FIG. 2 is an exploded perspective view illustrating a dirt suction guide device according to a first embodiment of the present invention.
Figure 3:
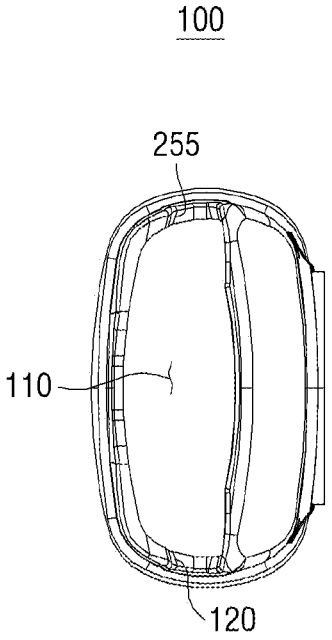
FIG. 3 is a front view illustrating a body illustrated in FIG. 2.
Figure 4:
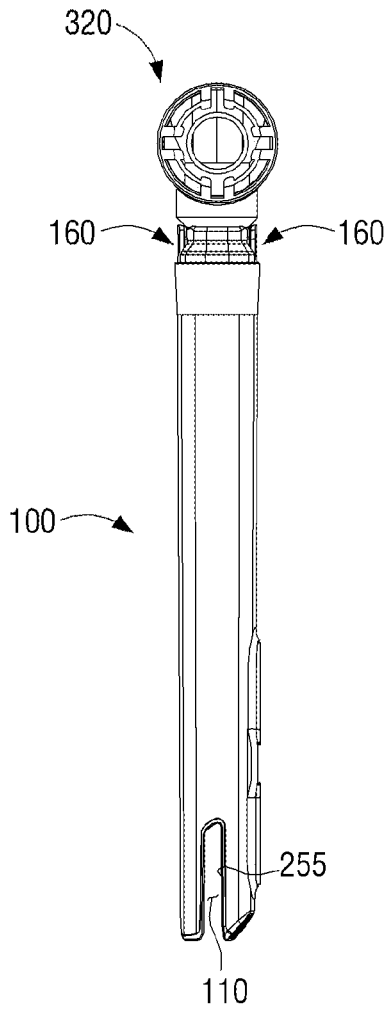
FIG. 4 is a plan view illustrating a body to which a second coupling part is coupled illustrated in FIG. 2.
Figure 5:
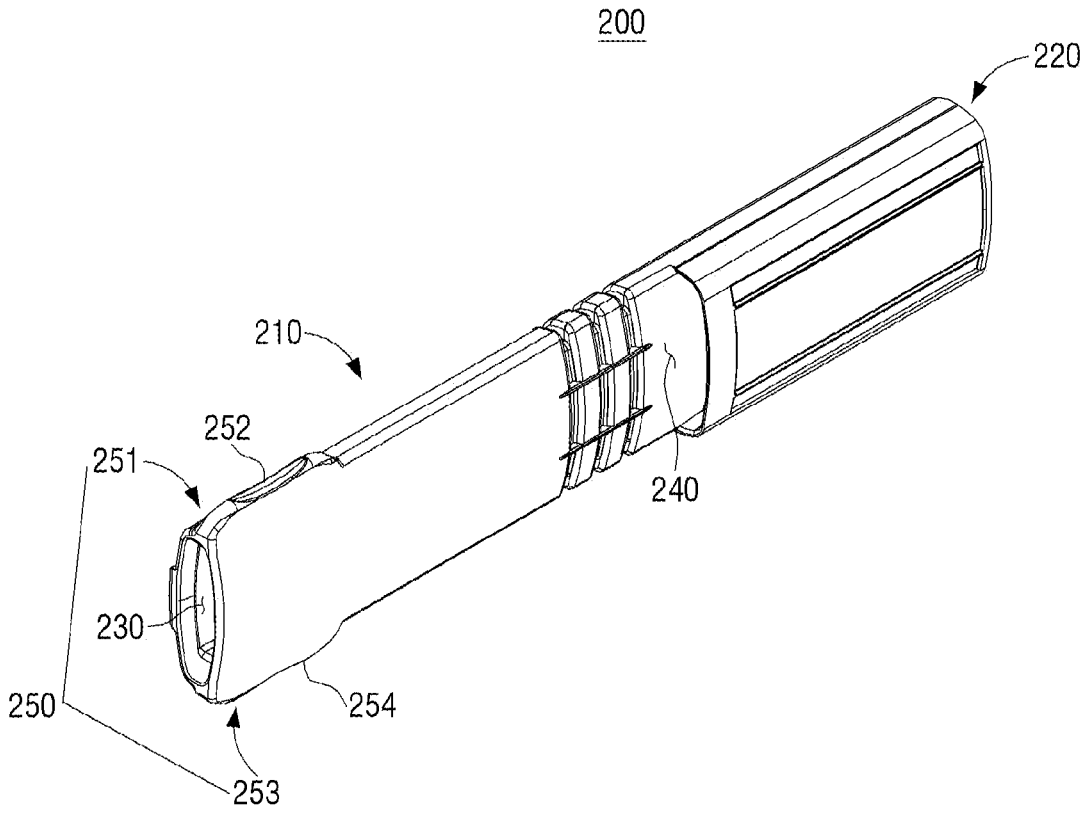
FIG. 5 is a perspective view illustrating one side of the dirt suction guide device illustrated in FIG. 2.
Figure 6:
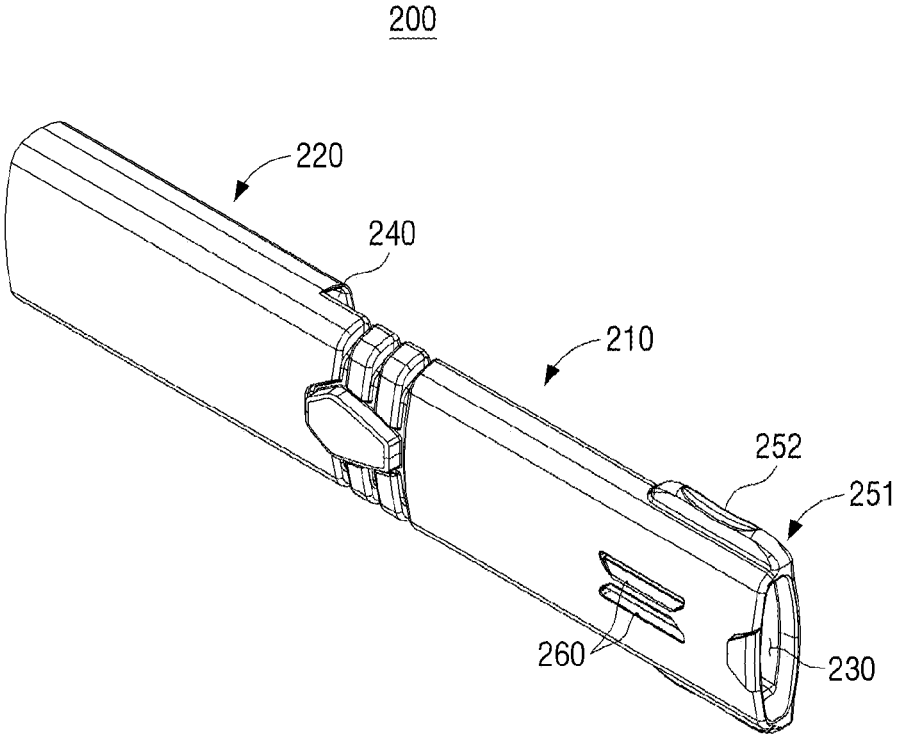
FIG. 6 is a perspective view illustrating the other side of the dirt suction guide device illustrated in FIG. 2.
Figure 7A:
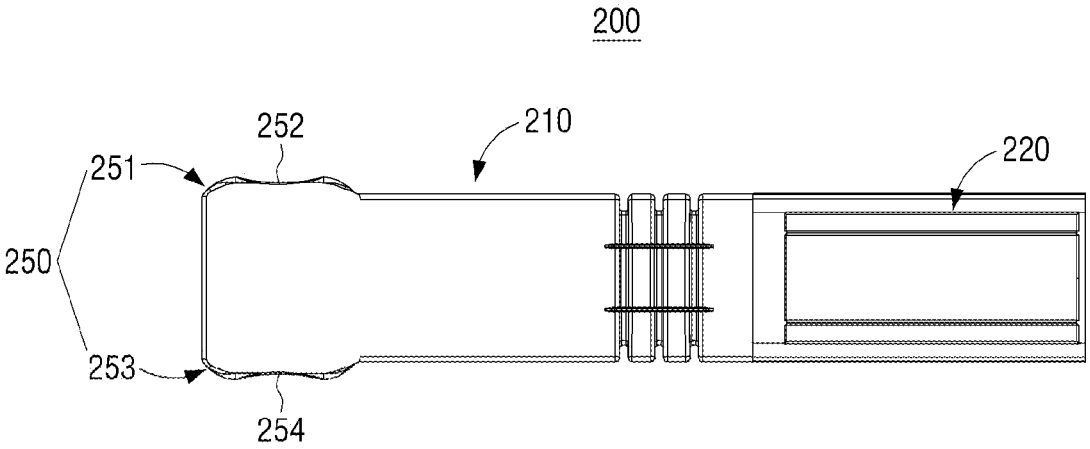
FIG. 7*a* is a side view illustrating a movable part according to an embodiment.
Figure 7B:
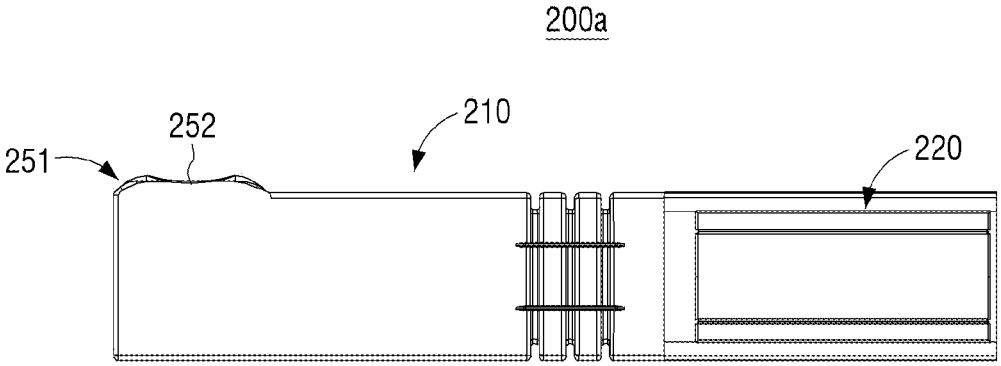
FIG. 7*b* is a side view illustrating a movable part according to another embodiment.

Hereinafter, the dirt suction guide device 20 according to the first embodiment of the present invention will be described with reference to the accompanying drawing. FIG. 2 is an exploded perspective view illustrating the dirt suction guide device 20 according to the first embodiment of the present invention. FIG. 3 is a front view illustrating a body illustrated in FIG. 2 and FIG. 4 is a plan view illustrating the body in a state that a second coupling part is coupled to the body illustrated in FIG. 2. FIG. 5 is a perspective view illustrating one side of the dirt suction guide device 20 illustrated in FIG. 2 and FIG. 6 is a perspective view illustrating the other side of the dirt suction guide device 20 illustrated in FIG. 2. FIG. 7A is a side view illustrating one example of a movable part 200 and FIG. 7B is a side view illustrating the other example of the movable part 200*a*.

Referring to FIGS. 2 to 7, the dirt suction guide device 20 may include a body 100, the movable part 200, a detent part 250, and a coupling part 300. The body 100 may be provided with a space portion 100*a* in the inside thereof and may be formed to have a certain length. Both ends of the body 100 may be opened and the space portion 100*a* may be formed in the inner side of the body 100. Both ends of the body 100 may communicate with each other through the space portion 100*a* and the air may flow from one end of the body to the other end of the body.

An opening 110 which communicates with the space portion 100*a* may be formed in one end of the body 100. The opening 110 may be formed in a substantially rectangular shape. Since a cross-section of the opening 110 is formed smaller than a cross-section of a rear portion of the movable part 200 to be described later, the movable part 200 may be prevented from being deviated to the outside of the body 100 even in a response to the movable part 200 being further moved to a draw-out direction (arrow D1 direction in FIG. 2) in a state that the movable part 200 is inserted into the body 100.

The open/close suction port 140 may be formed in one side surface of the body 100. The open/close suction port 140 may be formed in a substantially rectangular shape and may be selectively opened and closed through one side surface 220*a* of a second suction member 220 to be described later. The open/close suction port 140 may has an elliptical shape or various shapes other than the rectangular shape. The open/close suction port 140 may be used in gap cleaning as well as may be used to suck the dirt (dust) from fabrics such as a curtain installed in a room or clothes hanging on hangers.

The movable part 200 will be described in detail with reference to FIGS. 5 and 6.

Referring to FIGS. 5 and 6, the movable part 200 may be coupled to the body 100 to be drawn into and drawn out from the body 100 via the opening 110 formed in one end of the body 100. The movable part 200 may include a first suction member 210 and the second suction member 220.

The first suction member 210 may have a certain length, both ends of the first suction member 210 may be opened, and a space portion which the air and dirt pass therethrough may be formed in an inner side of the first suction member 210. The first suction member 210 may be formed of a flexible material so that the first suction member 210 is bent to various shapes and is restored to an original shape. As the first suction member 210 is formed of the flexible material, the first suction member 210 may be disposed in the body 100 in a contracted state by an external force. A first suction port 230 configured to suck the air and dirt may be formed in a front end of the first suction member 210 and a first flow path (see A of FIG. 12) which is connected to the first suction port 230 and passes through the first suction member 210 may be formed in the inside of the first suction member 210. The front end of the first suction member 210 may be formed to protrude toward a front side more than a front end of the second suction member 220 to be described later. A pressure adjusting hole 260 may be formed in the other side of the first suction member 210 to adjust the pressure generated in the first suction port 230 in response to the movable part 200 being set to the extension position.

Referring to FIGS. 7A and 7B, detent protrusions 251 and 253 may be formed in both sides of a front end portion of the first suction member 210 (see FIG. 7A) or a single detent protrusion 251 may be formed in one side of both sides in the front end portion of the first suction member 210 (see FIG. 7B). Detailed description for the detent protrusions 251 and 253 will be described later.

Referring back to FIGS. 2 to 6, the second suction member 220 may be formed to extend in a rear side of the one side surface of the first suction member 210 and openings are formed in the front end and rear end of the second suction member 220. The second suction member 220 may also be formed of a flexible material like the first suction member 210. However, the second suction member 220 may be formed of a rigid material unlike the first suction member 210. The second suction member 220 may be disposed to be fixed to one side of the first suction member 210. Accordingly, in response to the movable part 200 being set to the extension position, the second suction member 220 may be interfered by a fixing jaw 130 formed in a portion of the opening 110 and may be prevented from being deviated to the outer side of the body 100. Accordingly, the second suction member 220 may allow the movable part 200 to be set to the extension position. A second suction port 240 configured to suck the air and dirt may be formed in a front end of the second suction member 220 and a second flow path (see B of FIG. 12) which is connected to the second suction port 240 and passes through the second suction member 220 may be formed in the second suction member 220.

The detent part 250 may include at least one detent protrusion 251 and 253 and a pair of detent protrusion groove 255.

The detent protrusions 251 and 253 may be formed in both sides of the front end portion of the first suction member 210 to protrude the outer side of the first suction member 210 so that the detent protrusions 251 and 253 are received in the pair of detent protrusion grooves 255 formed in the body 100. A pair of detent protrusions 251 and 253 may be formed, but this is not limited thereto and the single detent protrusion 251 may be formed in one side of the front end portion. The detent protrusions 251 and 253 may be interfered by an edge of the detent protrusion groove 255 so that the detent protrusions 251 and 253 may not move anymore in response to the first suction member 210, which moves from the extension position to the contraction position, reaching the contraction position. Accordingly, the first suction member 210 may not move anymore and may be set to the contraction position.

Depressed portions 252 and 254 may be formed in one sides of the detent protrusions 251 and 253 so that the user grips the first suction member 210 and easily move the first suction member 210 from the contraction position to the extension position or, conversely, from the extension position to the contraction position. The depressed portions 252 and 254 may be manufactured in a shape in which a portion of the user's body, for example, an end portion of the finger joint may be placed. Accordingly, the user may apply force to the first suction member 210 and allow the first suction member 210 to move between the extension position and the contraction position in a state that the portion of the user's body is placed in the depressed portions 252 and 254.

The detent protrusion grooves 255 may be formed in both side portions of the one end of the body 100 formed with the opening 110 to extend toward the other end of the body 100 from an edge of the opening 110. The detent protrusions 251 and 253 may pass through the pair of detent protrusion grooves 255 and may be received in the pair of detent protrusion grooves 255.

The coupling part 300 may be located between the body 100 and the extension tube 30 and may rotatably hinge-couple the body 100 to the extension tube 30. The coupling part 300 may include a first coupling part 310, a second coupling part 320, a first deviation preventing part 330, a second deviation preventing part 340, a fixing part 350, an elastic member 360, and an extension tube coupling part 370.

The first coupling part 310 may be formed in a cylindrical shape having the space portion 100*a* in the inside thereof. A portion of an outer circumferential surface in the first coupling part 310 may be coupled to one end of the extension tube coupling part 370 so that the first coupling part 310 may communicate with the extension tube coupling part 370. A first coupling hole 312 may be formed in one end of the first coupling part 310 and a second coupling hole 313 may be formed in one side of the outer circumferential surface.

Accordingly, the second coupling part 320 may move to the inner side of the first coupling part 310 through the first coupling hole 312 and then the second coupling part 320 may be received in the first coupling part 310 in a state that the second coupling part 320 passes through the second coupling hole 313. Rotation holes 311 may be formed in portions of both-side edges of the coupling hole in the first coupling part 310 so that the second coupling part 320 may rotate in a received state in the first coupling part 310. Accordingly, the second coupling part 320 may rotate without interference by both-side edges of the coupling hole.

Figure 8:
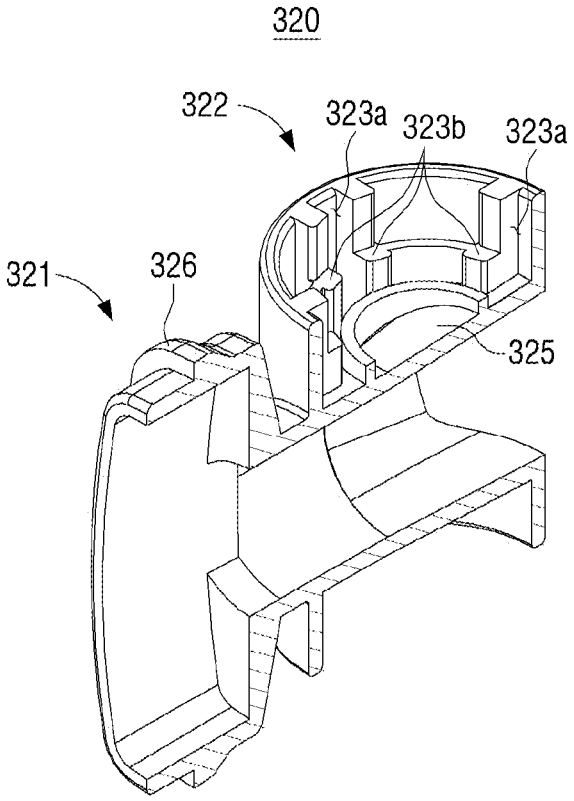
FIG. 8 is a cross-sectional perspective view illustrating a second coupling part.

FIG. 8 is a cross-sectional perspective view illustrating the second coupling part 320.

Referring to FIG. 8, the second coupling part 320 may be rotatably coupled to the first and second deviation preventing parts 330 and 340 to be described later and may be separately coupled to the other end portion of the body 100. The second coupling part 320 may be rotatably received in the first coupling part 310.

The second coupling part 320 may include a rotation portion 322 which is rotatably received in the inside of the first coupling part 310 and the coupling portion 321 connected to one side of the rotation portion 322 and connected to the other end portion of the body 100 as illustrated in FIGS. 2 and 5. Snap coupling protrusions 321*a* are formed in both-side surfaces of the coupling portion 321 and a pair of snap coupling protrusions 321*a* are snap-coupled to snap coupling grooves 161 formed to extend in the other end portion of the body 100.

The rotation portion 322 and the coupling portion 321 of the second coupling part 320 are formed to communicate with each other so that the body 100 and the first coupling part 310 communicate with each other. The rotation portion 322 may be formed in a cylindrical shape corresponding to the shape of the first coupling part 310 and a plurality of guide grooves 153*a* may be formed in one end portion of the rotation portion 322. A locking jaw 326, which is configured to interfere with the other end portion of the body 100 and prevent the body 100 from moving in response to an outer surface of the coupling part 300 which is in contact with and coupled to the inner surface of the other end portion of the body 100 being coupling to the other end portion of the body 100, may be formed in the coupling part 300.

Referring to FIG. 2, the first and second deviation preventing parts 330 and 340 may be disposed to surround the outer side of the first coupling part 310 so that the first coupling part 310 and the second coupling part 320 rotatably received in the inside of the first coupling part 310 may be prevented from being mutually deviated.

Figure 9:
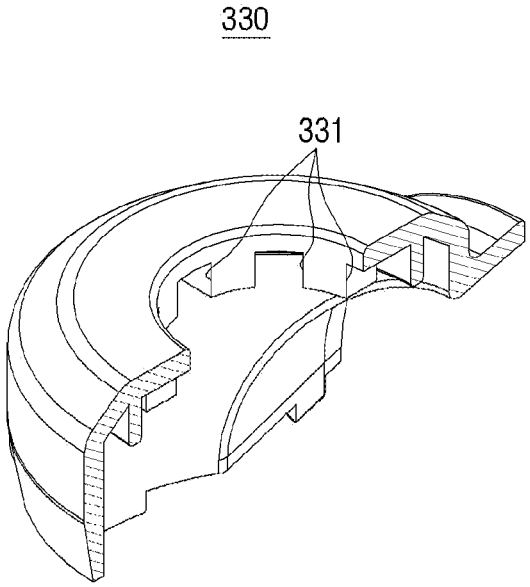
FIG. 9 is a cross-sectional perspective view illustrating a first deviation preventing part illustrating in FIG. 2.
Figure 10:
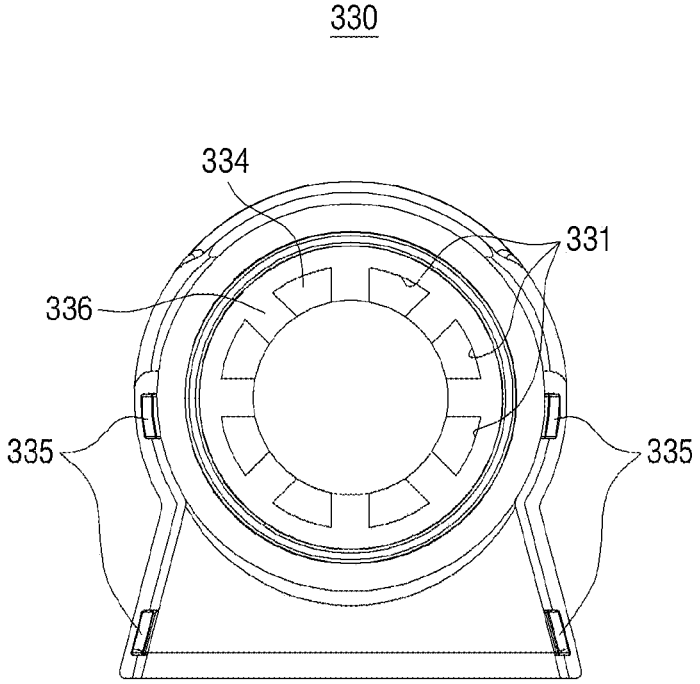
FIG. 10 is a bottom view illustrating a first deviation preventing part illustrated in FIG. 2.

FIG. 9 is a cross-sectional perspective view illustrating the first deviation preventing part 330 illustrated in FIG. 1 and FIG. 10 is a bottom view illustrating the first deviation preventing part 330 illustrated in FIG. 1.

Referring to FIGS. 9 and 10, the first deviation preventing part 330 may be disposed in an upper side of the first coupling part 310 and a plurality of locking grooves 331 formed at constant intervals may be in an inner circumferential surface of the first deviation preventing part 330. The plurality of locking grooves 331 may be formed so that locking protrusions 352 of the fixing part 350 to be described later are selectively received in the plurality of locking grooves 331 and the plurality of locking grooves 331 may include locking surfaces 334, which top surfaces of the locking protrusions 352 of the fixing part 350 are in contact therewith, in the inner side thereof. The deviation preventing part may include a first contact surface 336 which is formed between the plurality of locking grooves 331 and coupled to substantially form a rectangular angle with the inner surface thereof. A plurality of elastic protrusions 335 may be formed in an outer side of the first deviation preventing part 330 so that the first deviation preventing part 330 may be snap-fit-coupled to the second deviation preventing part 340.

The second deviation preventing part 340 may be disposed in a lower side of the first coupling part 310 as illustrated in FIG. 2. Elastic protrusion receiving grooves 341 may be formed in an outer side of the second deviation preventing part 340 so that the second deviation preventing part 340 may be snap-fit-coupled to the first deviation preventing part 330.

Through the above-described configuration, the first and second deviation preventing parts 330 and 340 may be formed to be snap-fit-coupled so that the first and second deviation preventing parts surround the first extension part 310 including the first coupling part 310 and the extension tube coupling part 370. Accordingly, the first and second deviation preventing parts 330 and 340 are mutually coupled to the first extension part 310 and the extension tube coupling part 370 and are not rotated with respect to each other. On the other hand, the first and second deviation preventing parts 330 and 340 non-interfere with rotation of the first coupling part 310.

The first and second deviation preventing parts 330 and 340 may include an element (hereinafter, referred to as 'angle adjusting part') configured to prevent the first coupling part 310 and the second coupling part 320 from being mutually deviated and simultaneously to adjust an angle of the body 100 to be described later. Accordingly, the dirt suction guide device 20 with a simple configuration and cost-saving may be provided.

Hereinafter, the angle adjusting part will be described in detail with reference to FIGS. 8 to 11.

The angle adjusting part may include the plurality of locking grooves 331, a plurality of guide grooves 323*a*, the fixing part 350, and the elastic member 360 which are configured to allow the body 100 to rotate by a preset angle.

The plurality of locking grooves 331 may be formed at constant intervals in the inner circumferential surface of the first deviation preventing part 330 as illustrated in FIGS. 9 and 10.

The plurality of guide grooves 323*a* may be formed at constant intervals in an inner circumferential surface of the second coupling part 320 as illustrated in FIG. 8.

Figure 11:
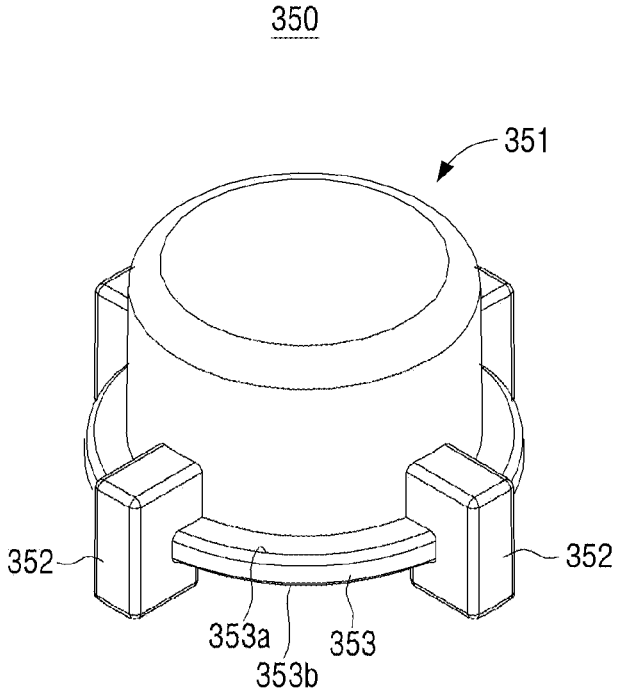
FIG. 11 is a perspective view illustrating a fixing part illustrated in FIG. 2.

The fixing part 350 will be described in detail with reference to FIG. 11. FIG. 11 is a perspective view illustrating the fixing part 350 illustrated in FIG. 1. Referring to FIG. 11, the fixing part 350 may include a bottom-opened fixing part body 351 formed in a cylindrical shape. The fixing part 350 may include a ring-shaped moving limit protrusion 353 formed to surround an outer circumferential surface thereof and may include the plurality of locking protrusions 352 formed in the outer circumferential surface at constant intervals along the moving limit protrusion 353 and formed to surround a top surface 353*a* and a bottom surface 353*b* of the moving limit protrusion 353. The moving limit protrusion 353 may be in selective contact with the first contact surface 336 and a second contact surface 323*b*. The plurality of locking protrusions 352 may be guided in a state received in the guide groove 323*a* and may be selectively received in portions of the plurality of locking grooves 331.

Hereinafter, an operation of the movable part 200 of the dirt suction guide device 20 will be described in detail with reference to FIGS. 12 to 14.

Figure 12:
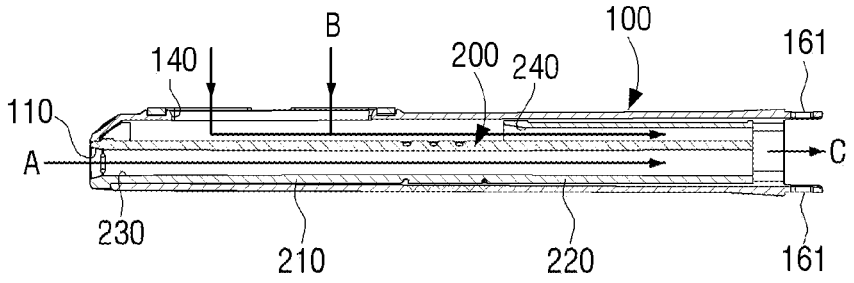
FIG. 12 is a diagram illustrating flow paths formed in a body and a movable part in a state that the movable part is set to a contraction position.
Figure 13:
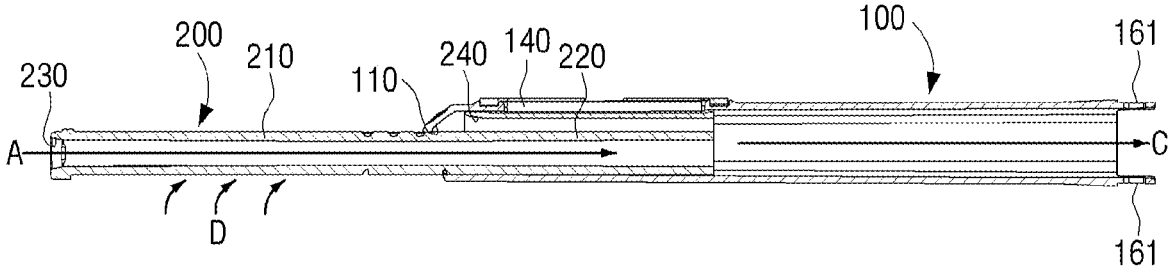
FIG. 13 is a diagram illustrating flow paths formed in a body and a movable part in a state that the movable part is set to an extension position.
Figure 14:
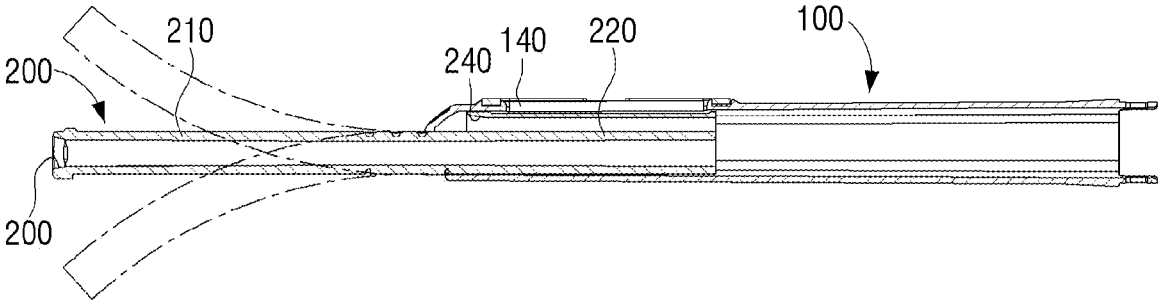
FIG. 14 is a diagram illustrating a deformation degree of a movable part formed of a flexible material in a state that a movable part is set to an extension position.

FIG. 12 is a diagram illustrating flow paths formed in the movable part 200 and the body 100 in a state that the movable part 200 is set to the contraction position, FIG. 13 is a diagram illustrating the flow paths formed in the movable part 200 and the body 100 in a state that the movable part 200 is set to the extension position, and FIG. 14 is a diagram illustrating a deformation degree of the first suction member 210 in a state that the movable part 200 is set to the extension position.

Referring to FIG. 12, the movable part 200 may be set to the contraction position that the movable part 200 is drawn into the inside of the body 100. In response to the movable part 200 being set to the contraction position, the dirt suction guide device 20 sucks air and dirt through the first suction port 230 and the open/close suction port 140. The open/close suction port 140 communicates with the second suction port 240.

Accordingly, first to third flow paths A, B, and C may be formed in the dirt suction guide device 20. That is, in the dirt suction guide device 20 in the contraction position, the first flow path A which is connected to the first suction port 230 and passes through the first suction port 230, the second flow path B which is connected to the open/close suction port 140 and passes through the second suction member 220 via the second suction port 240, and the third flow path C which is formed in the inside of the body 100 and connected to the first flow path A and the second flow path B may be formed.

Referring to FIG. 13, the movable part 200 may be set to the extension position that the movable part 200 is partially drawn out from the body 100 from the contraction position (see FIG. 12). As described above, in response to the movable part 200 being set to the extension position, the dirt suction guide device 20 sucks air and dirt through the first suction port 230. The open/close suction port 140 is blocked through the second suction member 220.

Accordingly, the air and dirt are sucked in the first suction port 230 and move to the cleaner main body 10 through the first flow path A and the third flow path C. The length of the third flow path C is increased as the movable part 200 is moved from the contraction position to the extension position and is set to the extension position. As the movable part 200 is set to the extension position, the second flow path B, which is formed in response to the movable part 200 being set to the contraction position, is blocked and the air and dirt are not moved. In response to the movable part 200 being set to the contraction position again, the second suction member 220 opens the open/close suction port 140 again. Accordingly, the second flow path B is also opened.

Referring to FIG. 14, in response to the movable part 200 being set to the extension position, the first suction member 210 may be partially drawn out from the body 100. The first suction member 210 formed of a flexible material may be bent in response to the pressure being applied to the dirt suction guide device 20 through the handle part 40 in order for the user to clean the surface to be cleaned. Through the freely deformed first suction member 210, a cleaning work may be efficiently performed on the surface to be cleaned having various sizes including a narrow space such as a gap.

Figure 15:
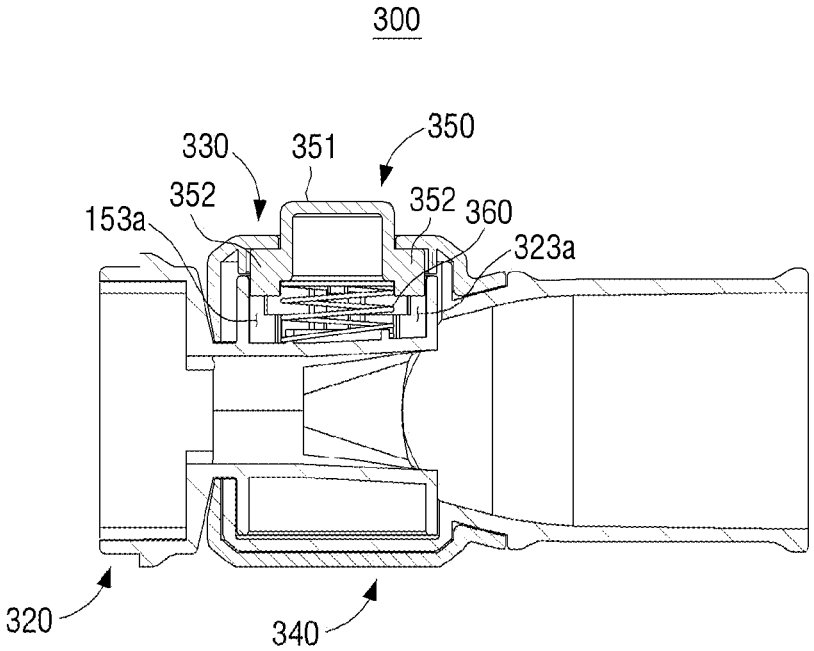
FIGS. 15 and 16 are diagrams illustrating an operation method of an angle adjusting part of a dirt suction guide device according to the first embodiment.
Figure 16:
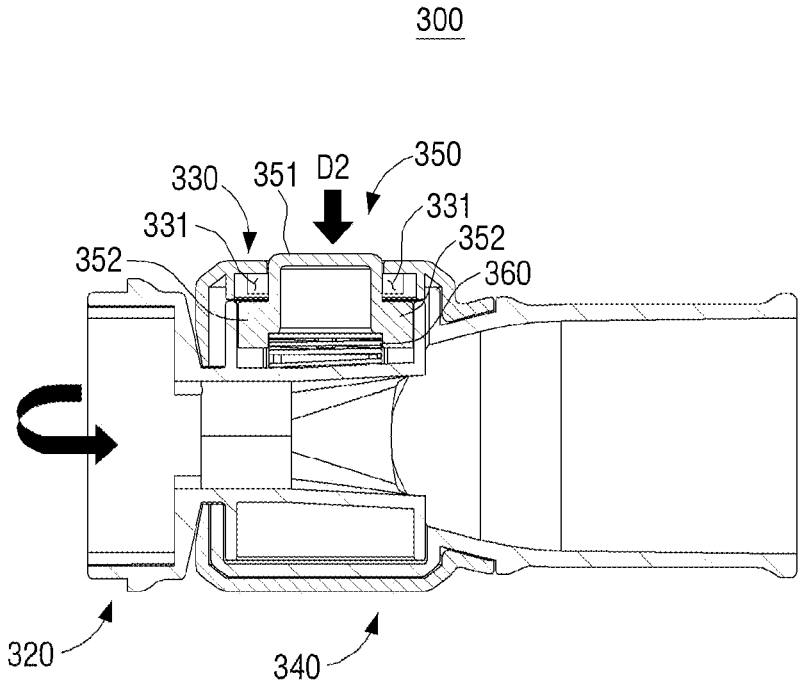

Hereinafter, the operation of the angle adjusting part will be described with reference to FIGS. 15 and 16. FIGS. 15 and 16 are diagrams illustrating an operation method of the angle adjusting part of the dirt suction guide device 20 according to the first embodiment.

Referring to FIGS. 15 and 16, the elastic member 360 disposed in a lower side of the fixing part 350 is disposed in the inside of the first deviation preventing part 330. The fixing part 350 is disposed so that the plurality of locking protrusions 352 are received in the plurality of guide grooves 323*a* and the plurality of locking grooves 331. The fixing part 350 is pressed upward through the elastic member 360. Accordingly, the fixing part 350 is fixed through the locking protrusions 352 received in the guide grooves 323*a* and the locking grooves 331 and thus the body 100 is not rotated with respect to the extension tube 30.

The user may press the fixing part 350 to an arrow D2 direction to rotate the body 100 by a certain angle with respect to the extension tube 30. In response to the pressed fixing part 350 being moved to the arrow D2 direction, the locking protrusions 352 of the fixing part 350 are deviated from the locking grooves 331. Thus, the first deviation preventing part 330 formed with the locking grooves 331 and the second coupling part 320 formed with the guide grooves 323*a* are in a mutual rotatable state. Accordingly, in response to the force being applied to the body 100 to the D2 arrow direction in order for the user to rotate the body 100, the second coupling part 320 connected to the other end portion of the body 100 is rotated with respect to the first deviation preventing part 330. The fixing part 350 which is continuously in a state received in the guide grooves 323*a* is rotated with the second coupling part 320.

Next, the force applied to the fixing part 350 being released by the user, the fixing part 350 moves to a reverse direction of the arrow D2 direction through the elastic force of the elastic member 360 again and is disposed so that the locking protrusion 352 is received in the locking groove 331.

Hereinafter, a dirt suction guide device 20*a* according to a second embodiment of the present invention will be described with reference to FIGS. 17 to 22. The same reference numerals are used for the same elements in the dirt suction guide device 20*a* according to the second embodiment and detailed description therefor will be omitted.

Figure 17:
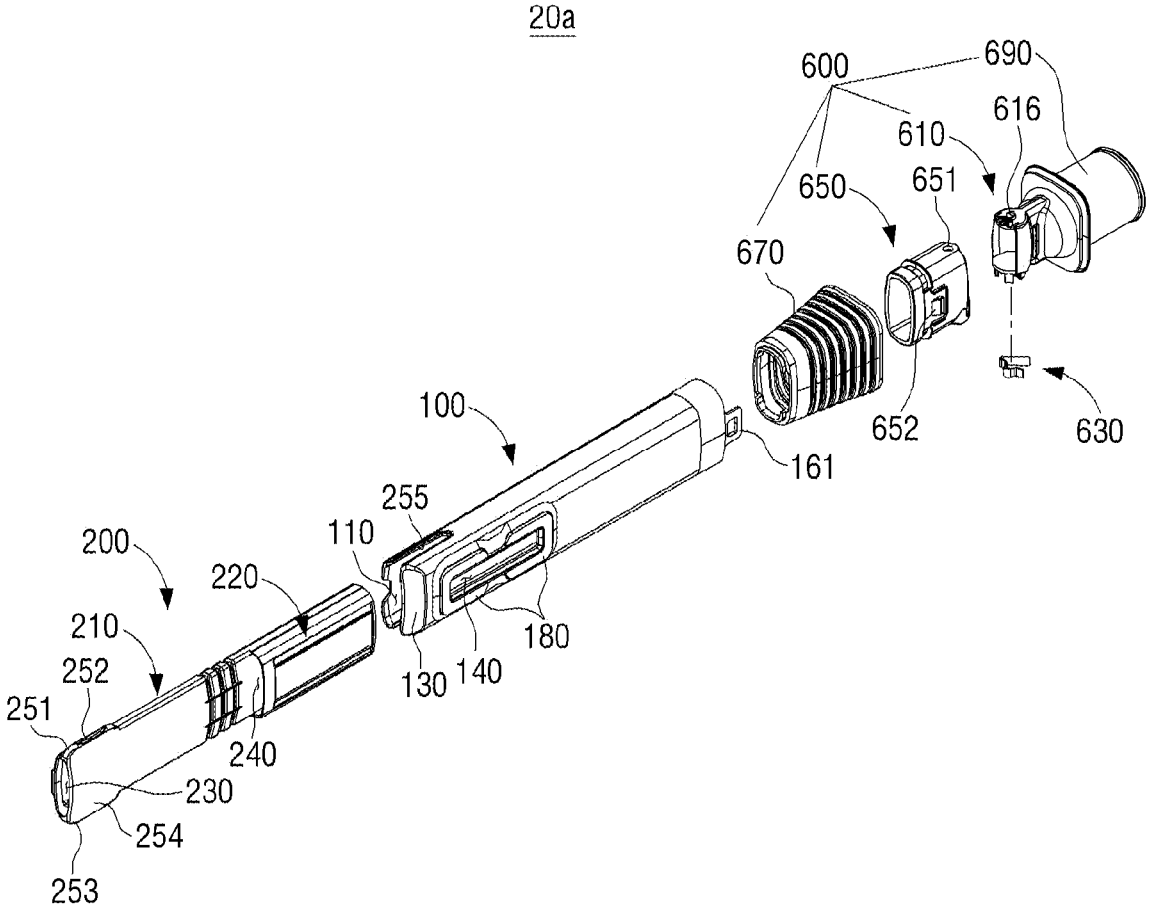
FIG. 17 is an exploded perspective view illustrating a dirt suction guide device according to a second embodiment of the present invention.
Figure 18:
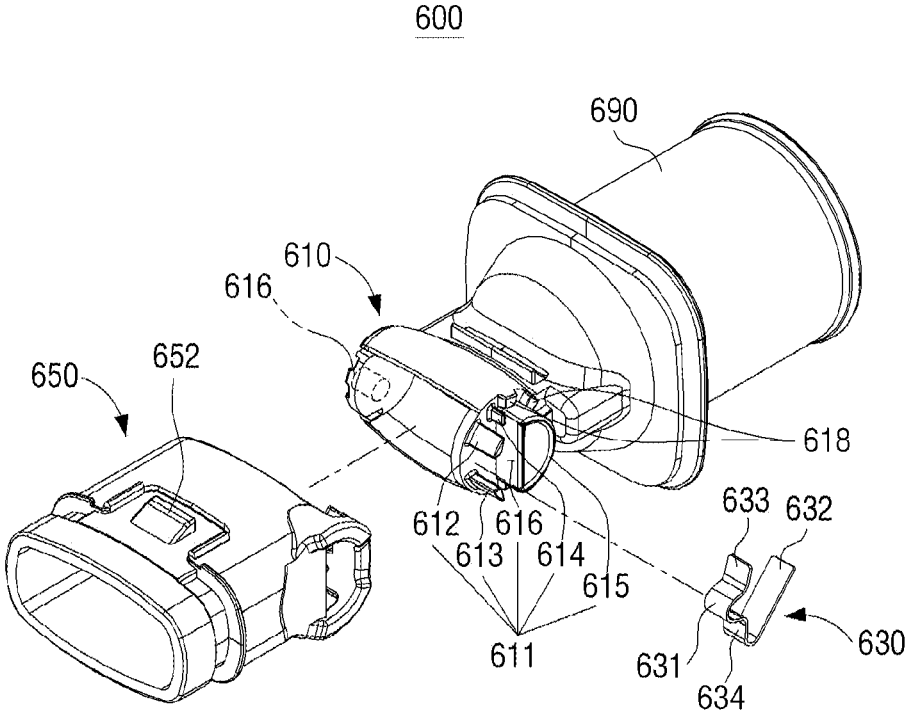
FIG. 18 is an exploded perspective view illustrating a coupling part illustrating in FIG. 17.
Figure 19:
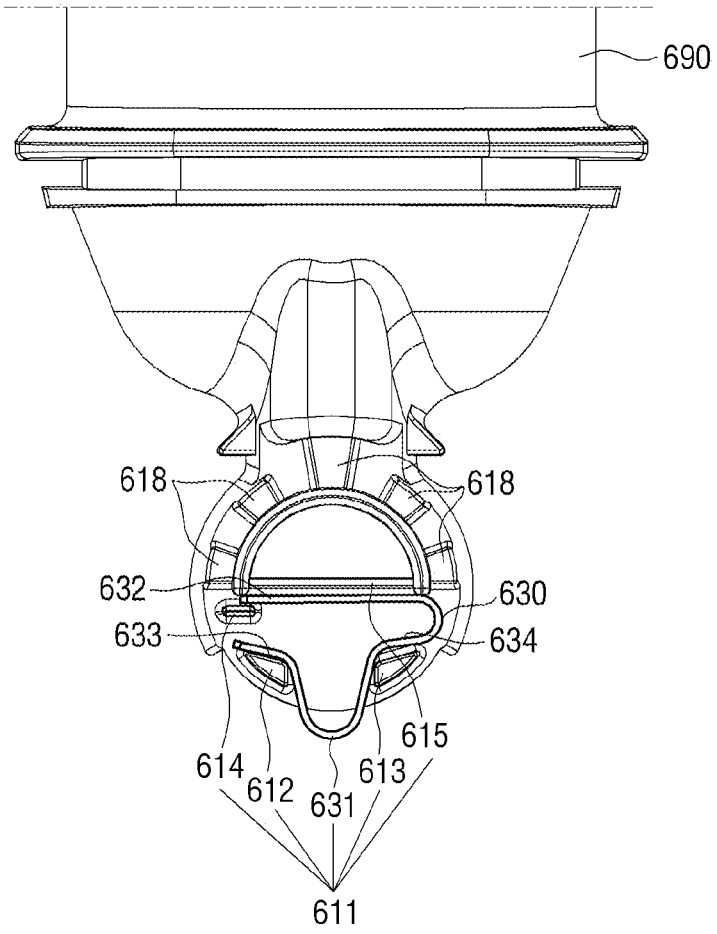
FIG. 19 is a bottom view illustrating a first coupling part illustrated in FIG. 17.
Figure 20:
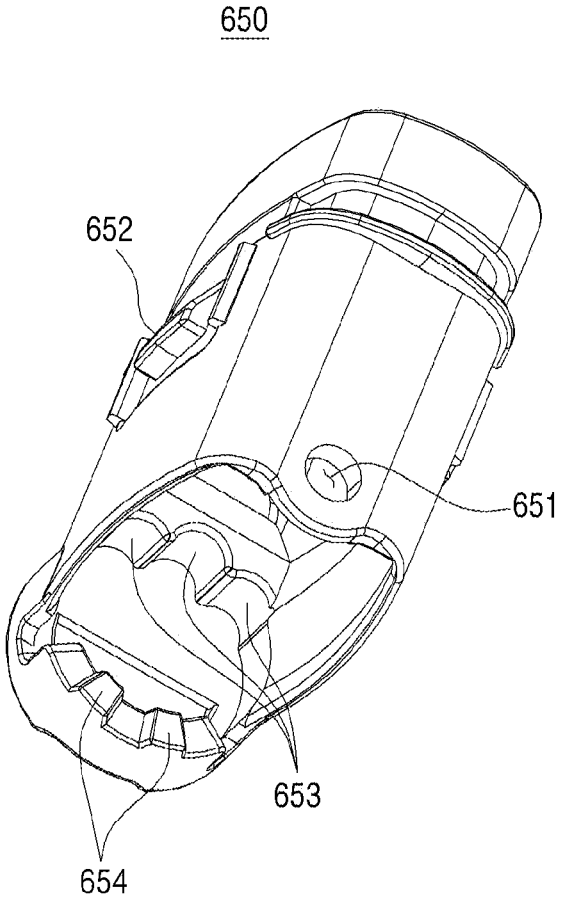
FIG. 20 is a perspective view illustrating a second coupling part illustrated in FIG. 17.
Figure 21:
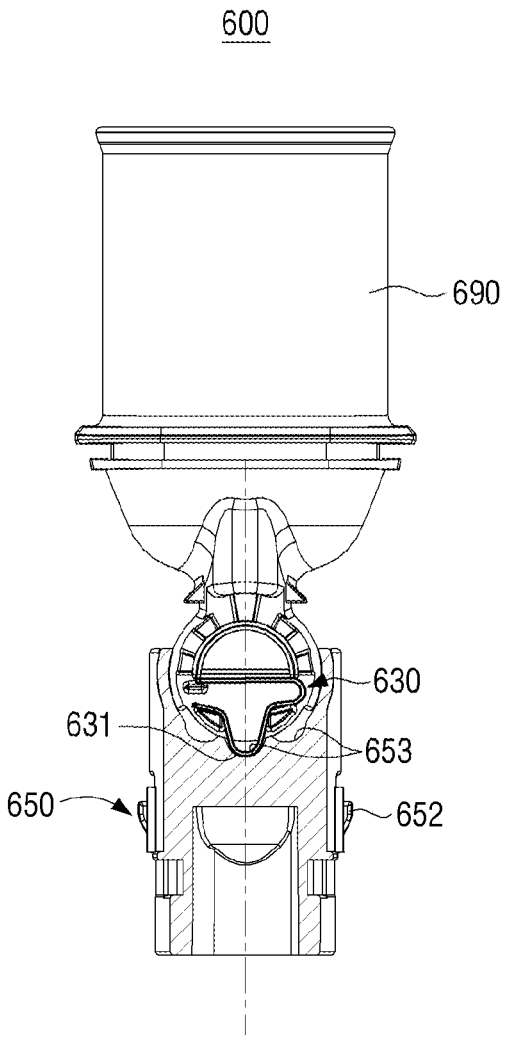
FIGS. 21 and 22 are diagrams illustrating an angle adjusting method of a dirt suction guide device according to the second embodiment.
Figure 22:
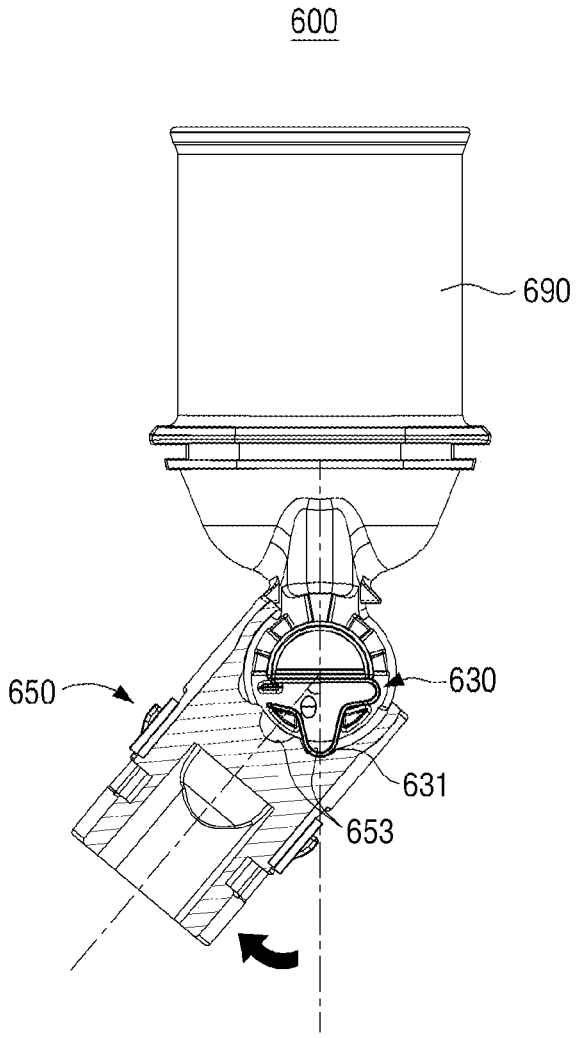

FIG. 17 is an exploded perspective view illustrating the dirt suction guide device 20*a* according to the second embodiment of the present invention, FIG. 18 is an exploded perspective view illustrating a coupling part illustrated in FIG. 17, FIG. 19 is a bottom view illustrating the first coupling part 310 illustrated in FIG. 17, FIG. 20 is a perspective view illustrating the second coupling part 320 illustrated in FIG. 17, and FIGS. 21 and 22 are diagrams explaining an operation method of an angle adjusting part of the dirt suction guide device 20*a* according to the second embodiment.

Referring to FIG. 17, a coupling part 600 may include a shaft part 610, a plate spring 630, a holder part 650, a flexible coupling member 670, and an extension tube coupling part 690.

The shaft part 610 may be formed in a cylindrical shape and may be formed in one side of the extension tube coupling part 690. Both ends portions of the shaft part 610 may be rotatably supported to the holder part 650 to be described later through a coupling shaft 616.

Referring to FIGS. 18 to 20, the shaft part 610 may include a fixing part 611 configured to fix the plate spring 630 in one end portion thereof. The fixing part 611 may be configured of first to fourth support parts 612, 613, 614, and 615 disposed at intervals so that a placing space 616 in which the plate spring 630 is to be placed is formed.

The coupling shaft 616 rotatably coupled to a coupling hole 651 of the holder part 650 is provided in the other end of the shaft part 610. The coupling shaft 616 may be a rotation center of the shaft part 610 for the holder part 650.

The shaft part 610 may include a plurality of first protrusion portions 618 formed at intervals along an outer circumferential surface of the fourth support part 615 having a substantially semicircular shape. The plurality of first protrusion portions 618 may be locked and unlocked to a plurality of second protrusion portions 654 of the holder part 650 to be described later.

The plate spring 630 may be configured to elastically couple the shaft part 610 to the holder part 650 and may be formed in an elongated plate shape having a narrow width and a portion of the plate spring 630 may be formed to be multistage-bent in a certain curvature.

A protrusion portion 631 is formed in one side of the plate spring 630 on the basis of a bent portion and first and second support ends 633 and 634 configured to be fixedly supported through the first and second support parts 612 and 613 of the shaft part 610 may be formed in both sides of the protrusion portion 631. A third support end 632 configured to be fixedly supported through the third and fourth support parts 614 and 615 of the shaft part 610 may be formed in the other side of the plate spring 630 on the basis of the bent portion.

The holder part 650 may be separately coupled to the other end portion of the body 100. For this, a pair of coupling protrusions 652 configured to be snap-coupled to a pair of snap coupling grooves 161 formed in the other end portion of the body 100 are formed in the holder part 650.

A plurality of receiving grooves 653 continuously formed along an inner circumferential surface may be provided in an inner side of one end portion of the holder part 650. The protrusion portion 631 of the plate spring 630 may be elastically coupled to any one of the plurality of receiving grooves 653.

Second protrusion portions 654 may be provided in the holder part 650 facing the plurality of receiving grooves 653. The second protrusion portions 654 may be locked and unlocked to the first protrusion portions 618 of the shaft part 610. The holder part 650 may be entirely formed of an elastic material so that the second protrusion portions 654 are elastically coupled to the first protrusion portions 618. Accordingly, in response to the force being applied by the user in a state that the second protrusion portions 654 of the holder part 650 are engaged in the first protrusion portions 618 of the shaft part 610, the second protrusion portions 654 of the holder part 650 may be repeatedly elastically contacted and expanded and may be elastically locked and unlocked to the first protrusion portions 618. The coupling part 600 may be further robust through the first and second protrusion portions 618 and 654 with the rotation operation.

A wrinkle portion may be formed in the flexible coupling member 670 so that the flexible coupling member 670 is easily bent and the flexible coupling member 670 may be disposed to surround the shaft part 610 and the holder part 650. Accordingly, the flexible coupling member 670 may prevent the shaft 610 and the holder part 650 from being exposed to the outside and improve an aesthetic sense of the outer appearance of the dirt suction guide device 20*a*.

The extension tube coupling part 690 may be integrally formed with the shaft part 610 to extend and may be formed in a front end of the extension tube 30 to communicate with the extension tube.

Hereinafter, an angle adjusting method of the dirt suction guide device 20*a* according to the second embodiment will be described in detail with reference to FIGS. 21 and 22. FIGS. 21 and 22 are diagrams explaining the angle adjusting method of the dirt suction guide device 20 according to the second embodiment.

Referring to FIG. 21, the body 100 is rotatably coupled to the coupling part 600. As described above, the plate spring 630 is fixed to the fixing part 611 formed in the shaft part 610. The protrusion portion 631 of the plate spring 630 is received in one of the plurality of receiving grooves 653 of the holder part 650.

Referring to FIG. 22, in response to the force being applied to rotate the body 100 by the user, the holder part 650 formed with a plurality of receiving grooves 653 of the elastic protrusion receiving part is rotated. The protrusion portion 631 of the plate spring 630 is elastically received in any one of the plurality of receiving grooves. Accordingly, a rotation angle θ (for example, about 25°) of the body 100 may be controlled by controlling the spacing angle θ of the plurality of receiving grooves 653.

The foregoing exemplary embodiments and advantages are merely exemplary and are not to be construed as limiting the present inventive concept. The description of the exemplary embodiments is intended to be illustrative, and not to limit the scope of the claims, and many alternatives, modifications, and variations will be apparent to those skilled in the art.

The invention claimed is:

1. A cleaner comprising:

a cleaner main body configured to generate suction force;

a flexible hose connected to the cleaner main body;

an extension tube connected to the flexible hose; and a dirt suction guide device separately coupled to the extension tube, wherein the dirt suction guide device includes:

a tubular body;

a movable part connected to a front portion of the tubular body and slidably coupled to the tubular body; and a coupling part connected to a rear portion of the tubular body and configured to couple the tubular body to the extension tube, wherein the tubular body is hinge-coupled to the coupling part so that the tubular body maintains and changes an angle with respect to the extension tube, wherein the movable part includes:

a first suction member including a first suction port formed in a front end of the first suction member and a first flow path connected to the first suction port and the tubular body and passing through the first suction member, and a second suction member formed to extend in a rear side of the first suction member, the second suction member including (i) a second suction port formed in a front end of the second suction member extending between the first and second suction members on an outer wall of the first and second suction members and cii) a second flow path that is enclosed and connected to the second suction port and the tubular body and passing through the second suction member, and wherein the tubular body includes an open/close suction port communicating with the second suction port and selectively opened and closed, and the open/close suction port configured to:

close to be blocked through the second suction member, in response to the movable part being set to an extension position based on the movable part extended from the tubular body, and open to communicate with the second suction port, in response to the movable part being set to a contraction position based on the movable part inserted into an inner side of the tubular body.

2. The cleaner according to claim 1, wherein the movable part further includes a detent part so that the movable part is set to the contraction position, and wherein the detent part includes:

at least one detent protrusion formed in the first suction member; and at least one detent protrusion groove formed in the tubular body so that the at least one detent protrusion passes through and is received in the at least one detent protrusion groove.

3. The cleaner according to claim 1, wherein:

the first suction member is formed of a flexible material to be bent, and the second suction member is formed of a rigid material.

4. The cleaner according to claim 1, further comprising a pressure adjusting hole formed in the first suction member and configured to adjust a pressure of the first suction port in the extension position.

5. The cleaner according to claim 1, wherein:

the first flow path extends from the first suction port of the first suction member to a second opening of the first suction member via an inner side of the first suction member;

the second flow path extends from the open/close suction port of the tubular body to a first opening of the second suction member, the inner side of the first suction member, and a second opening of the second suction member; and a third flow path is formed in an inside of the tubular body and connected to the first and second flow paths, and wherein the second flow path is blocked in the extension position and communicates with the outside in the contraction position, and a length of the third flow path is increased in the extension position and is reduced in the contraction position.

6. The cleaner according to claim 1, wherein the coupling part includes:

a first coupling part;

a second coupling part which is coupled to the tubular body and is rotatably received in the first coupling part; and a deviation preventing part configured to prevent the first coupling part and the second coupling part from being mutually separated, and wherein the deviation preventing part includes a first deviation preventing part disposed in an upper side of the first coupling part; and a second deviation preventing part separately coupled to the first deviation preventing part and disposed in a lower side of the first coupling part.

7. The cleaner according to claim 6, wherein the cleaner further includes an angle adjusting part configured to allow the tubular body to rotate by a preset angle, the angle adjusting part includes:

a plurality of locking grooves formed at constant intervals in the deviation preventing part;

a plurality of guide grooves formed at constant intervals in the second coupling part;

a fixing part including a plurality of locking protrusions guided in a state received in the guide grooves and selectively received in portions of the plurality of locking grooves; and an elastic member configured to press the fixing part toward a locking groove side.

8. The cleaner according to claim 1, wherein the coupling part includes:

a shaft part; and a holder part coupled to the tubular body and configured to rotatably support the shaft part.

9. The cleaner according to claim 8, wherein the cleaner further includes an angle adjusting part configured to allow the tubular body to rotate by a preset angle, the angle adjusting part includes:

a plurality of receiving grooves formed at constant intervals in the holder part; and a plate spring which is disposed in the shaft part and a portion thereof is sequentially elastically received in the plurality of receiving grooves along a rotation direction of the tubular body, and wherein the angle adjusting part includes a first protrusion portion formed in the shaft part; and a second protrusion portion coupled to the holder part and formed to be elastically locked and unlocked to the first protrusion portion.

10. The cleaner according to claim 1, wherein the tubular body selectively maintains an angle with respect to the extension tube.

11. A dirt suction guide device comprising:

a body;

a movable part connected to one side of the body and slidably coupled to the body; and a coupling part connected to another side of the body and configured to couple the body to an extension tube, wherein the body is hinge-coupled to the coupling part so that the body maintains and changes an angle with respect to the extension tube, wherein the movable part includes:

a first suction member including a first suction port formed in a front end of the first suction member and a first flow path connected to the first suction port and the body and passing through the first suction member, and a second suction member formed to extend in a rear side of the first suction member, the second suction member including (i) a second suction port formed in a front end of the second suction member extending between the first and second suction members on an outer wall of the first and second suction members and cii) a second flow path that is enclosed and connected to the second suction port and the body and passing through the second suction member, and wherein the body includes an open/close suction port communicating with the second suction port and selectively opened and closed and configured to:

close to be blocked through the second suction member, in response to the movable part being set to an extension position based on the movable part being extended from the body, and open to communicate with the second suction port, in response to the movable part being set to a contraction position based on the movable part inserted into an inner side of the body.

* * * * *